US007419005B2

(12) United States Patent
Al-Muraikhi

(10) Patent No.: US 7,419,005 B2
(45) Date of Patent: Sep. 2, 2008

(54) METHOD OF STIMULATING LONG HORIZONTAL WELLS TO IMPROVE WELL PRODUCTIVITY

(75) Inventor: Ahmed J. Al-Muraikhi, Khubar (SA)

(73) Assignee: Saudi Arabian Oil Company (SA)

( * ) Notice: Subject to any disclaimer, the term of this patent is extended or adjusted under 35 U.S.C. 154(b) by 212 days.

(21) Appl. No.: 10/898,833

(22) Filed: Jul. 26, 2004

(65) Prior Publication Data

US 2005/0028975 A1 Feb. 10, 2005

Related U.S. Application Data

(60) Provisional application No. 60/491,059, filed on Jul. 30, 2003.

(51) Int. Cl.
*E21B 43/16* (2006.01)

(52) U.S. Cl. ..... 166/306; 166/313; 166/380; 175/62

(58) Field of Classification Search ..... 166/50, 166/52, 268, 272.7, 306, 313, 380; 175/62; 137/561 R–616.7
See application file for complete search history.

(56) References Cited

U.S. PATENT DOCUMENTS 3,785,204 A 1/1974 Lisi
4,262,745 A 4/1981 Stewart
4,390,067 A * 6/1983 Willman ..... 166/50
4,523,477 A 6/1985 Miller
4,646,836 A * 3/1987 Goodhart ..... 166/50
5,016,710 A 5/1991 Renard et al.
5,074,360 A * 12/1991 Guinn ..... 166/50
5,450,902 A 9/1995 Matthews
6,186,232 B1 * 2/2001 Isaacs et al. ..... 166/272.7
6,425,448 B1 * 7/2002 Zupanick et al. ..... 166/50
6,488,087 B2 * 12/2002 Longbottom et al. ..... 166/313
6,729,394 B1 * 5/2004 Hassan et al. ..... 166/52
7,104,324 B2 * 9/2006 Wetzel et al. ..... 166/50
2001/0045280 A1 11/2001 Longbottom et al.

FOREIGN PATENT DOCUMENTS

WO WO 98/50679 11/1998

* cited by examiner

*Primary Examiner*—Richard E. Chilcot, Jr.
*Assistant Examiner*—Matt J Smith
(74) *Attorney, Agent, or Firm*—Bracewell & Giuliani LLP

(57) ABSTRACT

This invention relates to the field of treating subterranean formations to increase production. The method of the current invention is particularly useful in hydrocarbon wells that are long, for example, in excess of one kilometer. The method providing increasing production from a primary wellbore by intersecting this wellbore with a secondary wellbore near to the hydrocarbon production zone such that acid treatment or other treatment can be directed to the intersection.

9 Claims, 3 Drawing Sheets

METHOD OF STIMULATING LONG HORIZONTAL WELLS TO IMPROVE WELL PRODUCTIVITY

RELATED APPLICATIONS

This patent application claims priority to U.S. Provisional Patent Application Ser. No. 60/491,059 filed on Jul. 30, 2003, which is incorporated by reference in its entirety.

BACKGROUND OF THE INVENTION

1. Technical Field of the Invention

This invention relates generally to the field of treating subterranean formations to increase the production of oil and/or gas therefrom. In particular, the invention relates to a novel process to stimulate the hydrocarbon production zone of a single or multi lateral long horizontal hydrocarbon well by acid treatment.

2. Description of the Prior Art

Hydrocarbons (oil, natural gas, etc.) are obtained from a subterranean geologic formation (i.e., a "reservoir") by drilling a well that penetrates the hydrocarbon-bearing formation. This provides a partial flowpath for the oil to reach the surface. In order for oil to be "produced," that is travel from the formation to the wellbore (and ultimately to the surface) there must be a sufficiently unimpeded flowpath from the formation to the wellbore. This flowpath is through the formation rock—e.g., sandstone, carbonates—which has pores of sufficient size and number to allow a conduit for the oil to move through the formation.

One of the most common reasons for a decline in oil production is "damage" to the formation that plugs the rock pores and therefore impedes the flow of oil. This damage generally arises from another fluid deliberately injected into the wellbore, for instance, drilling fluid. Even after drilling, some drilling fluid remains in the region of the formation near the wellbore, which may dehydrate and form a coating on the wellbore. The natural effect of this coating is to decrease permeability to oil moving from the formation in the direction of the wellbore.

Another reason for lower-than-expected production is that the formation is naturally "tight," (low permeability formations) that is, the pores are sufficiently small that the oil migrates toward the wellbore only very slowly. The common denominator in both cases (damage and naturally tight reservoirs) is low permeability. Techniques performed by hydrocarbon producers to increase the net permeability of the reservoir are referred to as "stimulation." Essentially, one can perform a stimulation technique by: (1) injecting chemicals into the wellbore to react with and dissolve the damage (e.g., wellbore coating); (2) injecting chemicals through the wellbore and into the formation to react with and dissolve small portions of the formation to create alternative flowpaths for the hydrocarbon (thus rather than removing the damage, redirecting the migrating oil around the damage); or (3) injecting chemicals through the wellbore and into the formation at pressures sufficient to actually fracture the formation (hydraulic fracturing), thereby creating a large flow channel though which hydrocarbon can more readily move from the formation and into the wellbore.

When a hydrocarbon-bearing, subterranean reservoir formation does not have enough permeability or flow capacity for the hydrocarbons to flow to the surface in economic quantities or at optimum rates, hydraulic fracturing or chemical (usually acid) stimulation is often used to increase the flow capacity as described above. A wellbore penetrating a subterranean formation typically consists of a metal pipe (casing) cemented into the original drill hole. Lateral holes (perforations) are shot through the casing and the cement sheath surrounding the casing to allow hydrocarbon flow into the wellbore and, if necessary, to allow treatment fluids to flow from the wellbore into the formation.

There are generally two types of acid treatment: fracture acidizing (injection of acid at rates above fracture pressure to etch the faces of the resultant fractures) and matrix acidizing (injection of acid at rates below fracture pressure to dissolve flow channels in the rock or to remove scale or damage caused by drilling). Acid treatments are employed in all types of oil wells and occasionally in water wells: they may be used to open fractures or remove damage in newly drilled wells or to rehabilitate old wells from which production has declined.

Hydraulic fracturing consists of injecting viscous fluids (usually shear thinning, non-Newtonian gels or emulsions) into a formation at such high pressures and rates that the reservoir rock fails and forms a plane, typically vertical, fracture (or fracture network) much like the fracture that extends through a material as a result of a wedge being driven into it. Granular proppant material, such as sand, ceramic beads, or other materials, is generally injected with the later portion of the fracturing fluid to hold the fracture(s) open after the pressures are released. Increased flow capacity from the reservoir results from the more permeable flow path left between grains of the proppant material within the fracture(s). In chemical stimulation treatments, flow capacity is improved by dissolving materials in the formation or otherwise changing formation properties.

Aqueous acid solutions, acid-like fluids or fluid of similar function are commonly used to treat oil or gas wells. For example, subterranean well formations are often contacted with aqueous acid solutions to increase the permeabilities of the formations whereby the production of oil and/or gas therefrom is increased. Aqueous acid solutions are also utilized to etch flow channels in the faces of fractures formed in the formations and to clean out perforations and tubular goods in wells.

Formation damage removal and effective stimulation of horizontal wells are known industry challenges. It is also known to stimulate vertical wells using acid treatment, also called acid stimulation. Horizontal wells, in addition to the greater length, experience increased possible difficulties during acid treatment involving coil tubing units or CTU. Selection of the appropriate acid is made applying criteria known in the art.

Acid treatment is used during the cleaning of new long horizontal hydrocarbon wells or to increase the productivity of such long horizontal wells. The conventional method of acid treatment is to use a Coil Tubing Unit (CTU) such that the acid treatment fluids is pumped through the CTU which is extended into the wellborn such that the acid treatment fluids are introduced into the hydrocarbon production zone in order to clean it out and increase permeability. This technique can be used for oil, gas, and water wells. The limitations in this method relate to the length of the well and mechanical limitations introduced through the insertion of the CTU. For example, acid treatment is generally considered ineffective for long wells, such as those in excess of one kilometer.

Acids useful in such stimulation or acid treatment processes are typically extremely active, such as hydrofluoric acid. Therefore, methods of acid treatment have typically diverged greatly from other methods of injection due to the nature of the acid.

Means of injecting substances other than acid have been described. For example, U.S. Pat. No. 4,262,745 teaches the injection of steam when two vertical wells are connected subsurface by a conduit or other means near the surface. This is intended to stimulate heavy oil producing wells using steam. This subsurface conduit serves the single purpose of allowing the steam to be injected and is not otherwise a useful wellbore. It also is not intended to carry erosive or fracture fluids such as those used in acid stimulation.

It would be advantageous to provide a means for cleaning of new wells such that the entire length of the wellbore is cleaned. It would be advantageous to also provide a means for such cleaning that is effective for long horizontal wells. It would be particularly advantageous to provide a method wherein acid treatment can be used.

It would be advantageous to provide a means for stimulating production of the formation. It would be advantageous to also provide a means for such stimulation that is effective for long horizontal wells.

SUMMARY OF THE INVENTION

The method of the current invention is particularly useful in hydrocarbon wells that are long, for example, in excess of one kilometer (approximately 3000 feet) in length, although it can be used in shorter wells. The method includes drilling two wells that intersect downhole to create sub-surface connected wells. The method includes one horizontal well with a primary wellbore and a second well defining a second wellbore that can be substantially horizontal or conventional, such as substantially vertical, the secondary wellbore intersecting the primary wellbore. The intersecting of the primary wellbore with the secondary wellbore creates an intersection. This intersection is most advantageously made at or near the hydrocarbon production zone. Acid treatment is directed to the intersection. Advantageously, the acid treatment fluids can circulate between wells such that the fluids can enter the primary wellbore and leave through the secondary wellbore. Alternately, the fluids can enter the secondary wellbore and leave through the primary wellbore. In certain cases, such as matrix acidizing, the treatment fluid does not exit the formation. This substantially improves the ability to perform acid treatment on long wells. This is also performed without the use of CTU.

Demulsified acid is useful in this method for stimulation purposes as it has the property of becoming active upon reaching the appropriate wellbore zone rather that stimulating other parts of the formation. Several types of acid formulas can be used in this method, which are known to the art. Generally speaking, acids, or acid-based fluids, are useful in this regard due to their ability to dissolve both formation minerals and contaminants (e.g., drilling fluid coating the wellbore or that has penetrated the formation) which were introduced into the wellbore/formation during drilling or remedial operations. Each stimulation job requires a certain type of acid formula depending on the goal of the stimulation job. For instance, sandstone formations are often treated with a mixture of hydrofluoric and hydrochloric acids at very low injections rates to avoid fracturing the formation. This acid mixture is often selected because it will dissolve clays found in drilling mud as well as the primary constituents of naturally occurring sandstones (e.g., silica, feldspar, and calcareous material). The dissolution is often so rapid that the injected acid is essentially spent by the time it reaches a few inches beyond the wellbore. The method of the current invention is useful in each case. For examples, when the stimulation is carried out to clean the wellborn of the drilling fluids after the completion of the drilling, this can be carried out by pumping the acid from primary wellhead of the primary well and receiving the acid was from the secondary wellhead of the secondary well.

BRIEF DESCRIPTION OF THE DRAWINGS

So that the manner in which the features, advantages and objects of the invention, as well as others that will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAILED DESCRIPTION OF THE INVENTION

Figure 1:
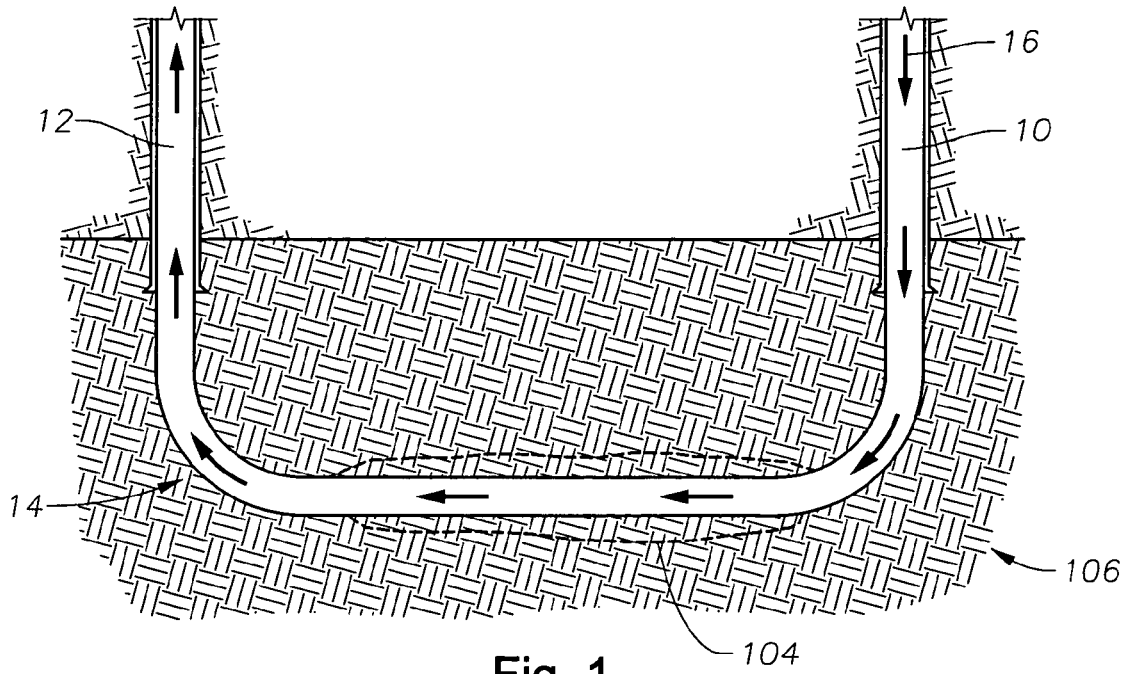
FIG. 1 depicts a preferred embodiment of the invention including acid treatment applied to well A and removal of acid through the intersection with Well B.

In that longer wells are more difficult to treat, the current invention advantageously provides a method to clean long wells. For each long horizontal hydrocarbon primary wellbore 10, at least one vertical or horizontal secondary well 12 is drilled in order to intersect downhole with primary well 10. Once intersection 14 is established between the primary and secondary wells, the acid treatment fluids 16, or other stimulation fluids useful to stimulate the wellbore or to clean it after drilling fluid operations and the completion of the drilling or workover operations, will be circulated by pumping the stimulation fluids 16 into and through the primary well and returning the stimulation fluids to the surface through the secondary well. FIG. 1 demonstrates this configuration with acid 16 being pumped down primary wellborn 10 and out through wellbore 12. For example, when the stimulation is carried out to clean the wellborn of the drilling fluids after the completion of the drilling, this can be carried out by pumping the acid from primary wellhead 10 and receiving the acid was from the wellhead of secondary wellhead 12 as demonstrated. This acid wash removes damage from damage zone 104 of formation 106 and stimulates production.

Figure 2:
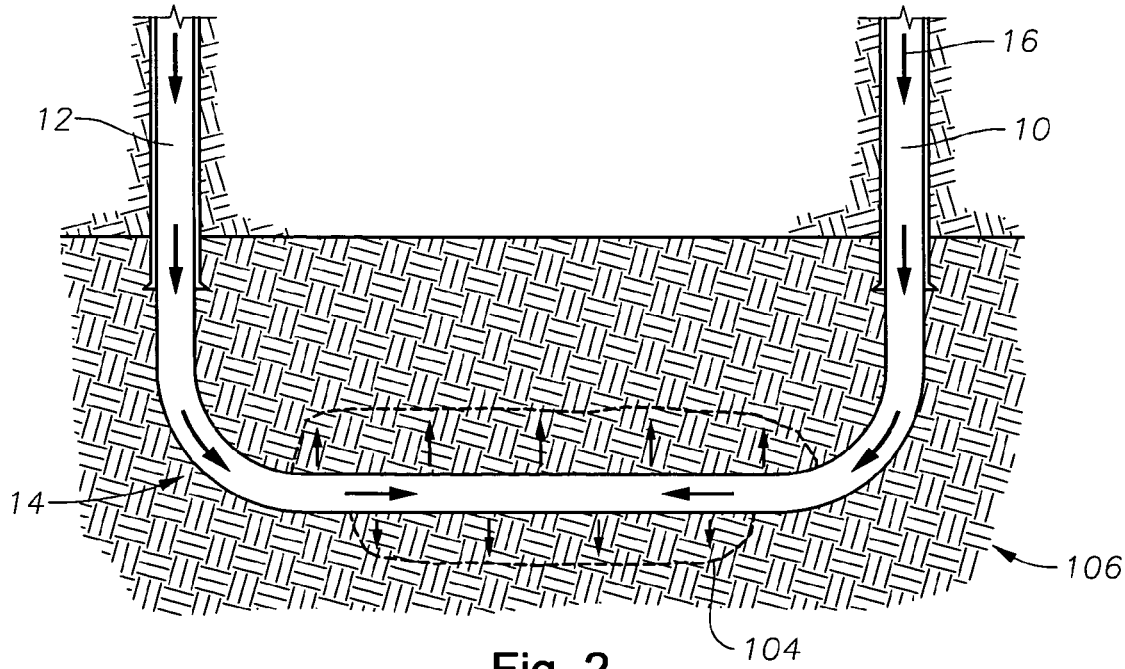
FIG. 2 depicts a preferred embodiment of the invention with acid treatment applied to well A and well B.
Figure 3:
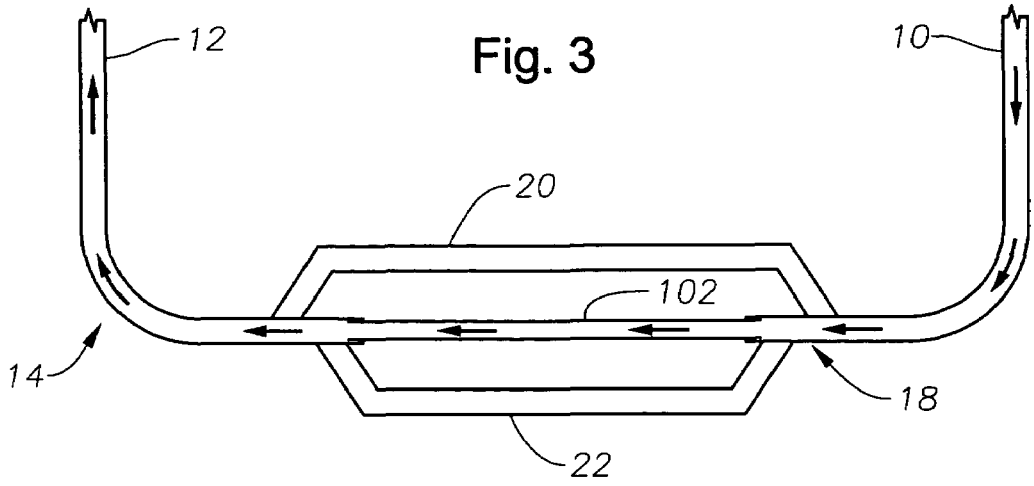
FIGS. 3-5 are schematics depicting various completion strategies including the current invention.
Figure 4:
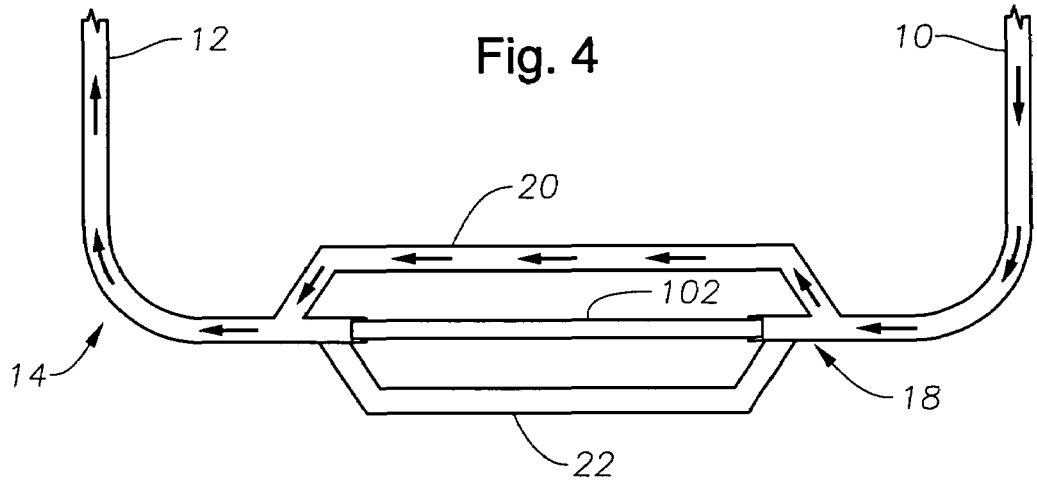
Figure 5:
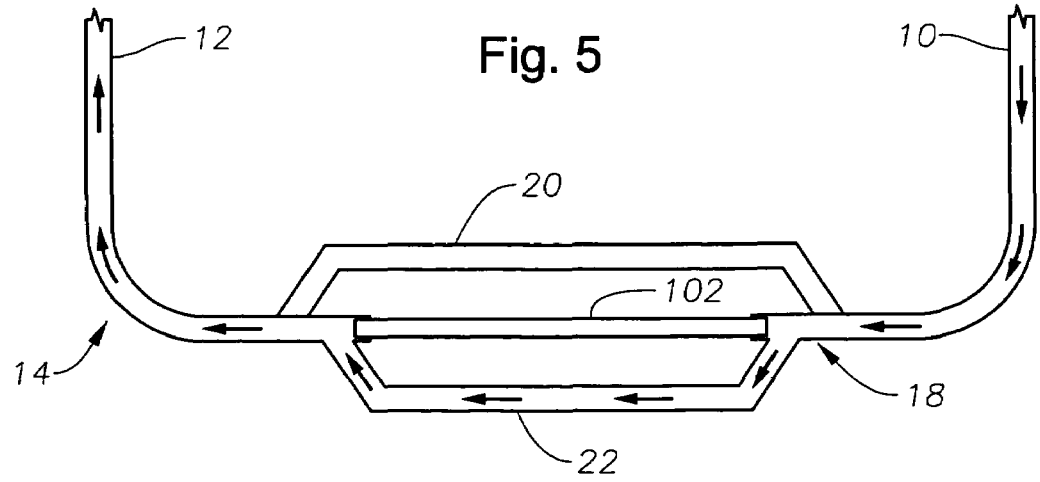
Figure 6:
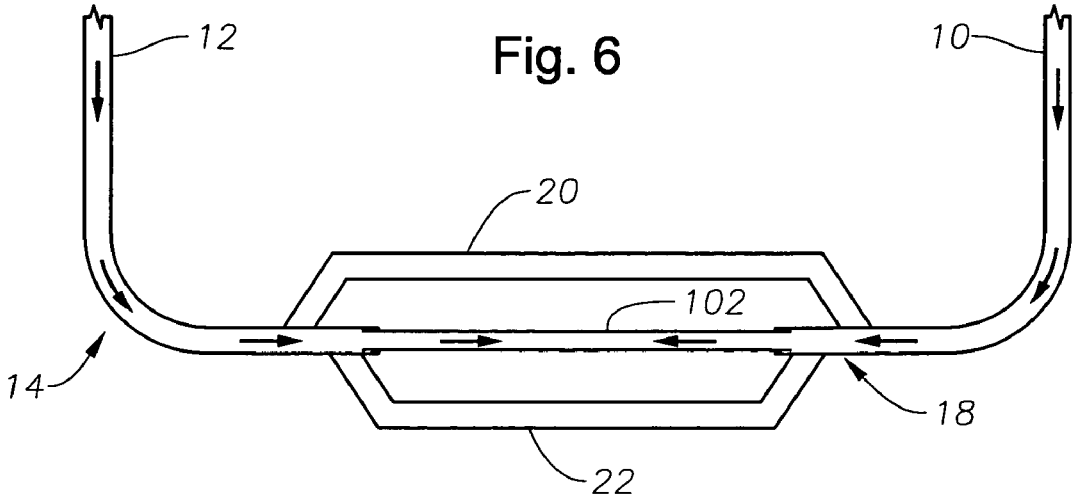
FIGS. 6-8 are schematics depicting various strategies including the addition of treatment fluid from both wells.
Figure 7:
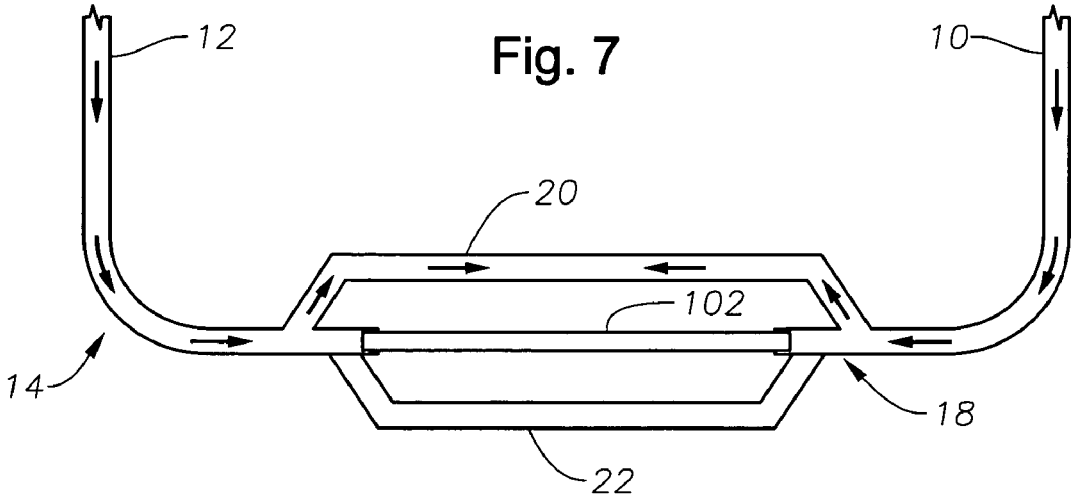
Figure 8:
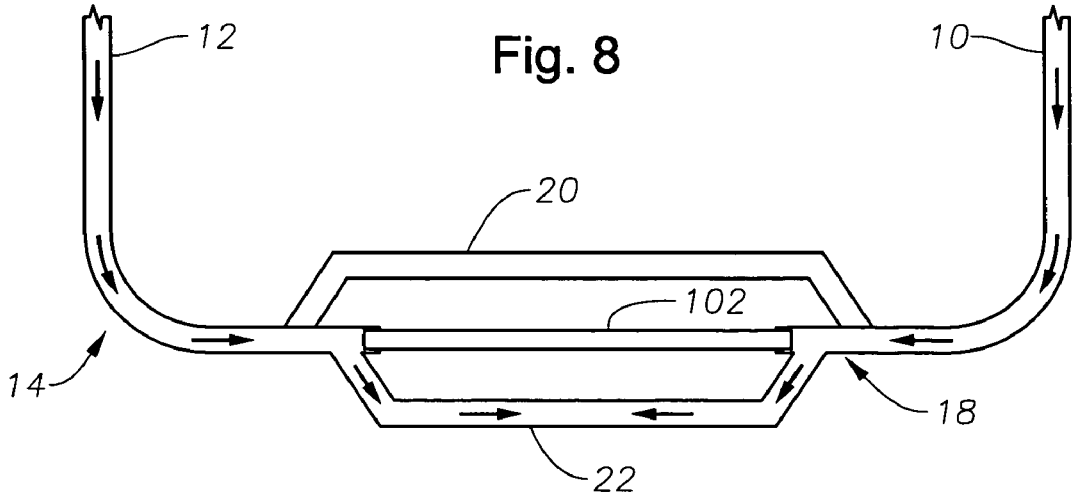

FIG. 2 demonstrates acid being pumped into both primary wellbore 10 and secondary wellbore 12 without removal of the acid. This demonstrates matrix acidizing, which can permeate several feet into the formation. Formation damage removal is one use for the configuration show in FIG. 2. FIG. 3 shows a completion strategy for connected wells including the use of a sleeve 102 or other devise to permit flow through a primary lateral wellbore portion 18 to be treated. FIG. 4 shows an alternate embodiment with circulation limited to a secondary lateral wellbore portion 20 with the primary lateral wellbore portion being bypassed. FIG. 5 demonstrates acid flow through a tertiary lateral wellbore 22. Alternately, multiple lateral wellbore sections can be treated simultaneously. FIG. 6 shows matrix acidizing strategy for connected wells including the use of a sleeve 102 or other devise to permit flow through a primary lateral wellbore portion 18 to be treated while one or more of the other lateral wellbore portions are closed. FIG. 7 shows an alternate embodiment of matrix acidizing with circulation limited to a secondary lateral wellbore portion 20 with at least the primary lateral wellbore portion being bypassed. FIG. 8 demonstrates matrix acidizing through a tertiary lateral wellbore 22. Alternately, multiple lateral wellbore sections can be treated simultaneously.

Advantageously, the current invention removes the need for costly CTU and eliminates the possibility of difficulties with the CTU such as loss or sticking of CTU downhole. Thus, the invention not only provides a method of acid washing for wells that are too long for CTU, but also an alternative to CTU for wells of shorter length where CTU could be used.

Use of the method of the invention avoids the necessity of CTU since the fluids can be pumped, for example, using a high-pressure pump, into the primary well and received out of the secondary well. This avoids many of the shortcomings of CTU including mechanical limitations that typically make it difficult to treat long wells, for example, those in excess of one kilometer. Also, additional wellbore operations such as CTU increase costs, mechanical risks, and risks of damage to the fractured intervals. The current invention advantageously can be used with both short and long wells, but provides the added advantage of promoting production from long horizontal wells that otherwise would not be producing at the desired rates. The current method also advantageously allows for exposing the length of the wellbore to acid to allow cleaning of the formation from the drilling fluid left after the completion of the drilling or workover operations, since the acid will dissolve the drilling fluid materials that have moved into the formation. This also provides increase in production.

This acidizing technique enables the removal of the formation damage created during the drilling at the same time maximizing the stimulation of the entire horizontal section, which will result in improving the productivity and thereby producing hydrocarbons at a higher rate.

The method of the invention is useful for single or multi lateral long horizontal wells. If two multilateral horizontal wells are connected downhole, the acid stimulation can be carried out for all the laterals at once or the acid stimulation can be performed individually while eliminating the other laterals through sleeve insertions, as demonstrated in FIGS. 3, 4 and 5. The method of the invention can be used with conventional diversion or foam techniques.

Another example of stimulation includes increasing the permeability of the wellbore to increase the productivity of the well, which is called matrix acidizing. Matrix acidizing is accomplished by pumping acid through both the primary and secondary wellheads into the wellbores and allowing the acid to penetrate through the formation of the wellbore for a predefined distance or for a predefined amount of time. An example would be to allow the acid to penetrate a few feet through the formation. This is followed by washing out the acid thereby producing hydrocarbon from primary and secondary wells. The acid is deployed through means known in the art.

While the invention has been shown or described in only some of its forms, it should be apparent to those skilled in the art that it is not so limited, but is susceptible to various changes without departing from the scope of the invention.

I claim:

1. A process for increasing production of a well, the well including a primary well having a primary wellbore and a primary production zone, the process comprising the steps of:

drilling a secondary well with a secondary wellbore such that the secondary wellbore intersects the primary wellbore to create an intersection, the intersection being situated relatively near to the primary production zone, wherein the primary well is defined by a length in excess of one kilometer in length and wherein the primary well is a horizontal well; and introducing a treatment fluid into the primary or secondary well such that increased production is stimulated from the production zone of the primary well;

wherein the treatment fluid is introduced into the primary or secondary well through the use of a high pressure pump; and wherein the high pressure pump is used to move the treatment fluid such that the treatment fluid does not pass through a coil tubing unit.

2. The process of claim 1 wherein the treatment fluid is an acid treatment fluid.

3. The process of claim 1 wherein the treatment fluid is introduced into both the primary and secondary well.

4. The process of claim 1 further comprising the step of washing out the acid producing the hydrocarbon from the well.

5. The process of claim 1 wherein the treatment fluid is pumped into the primary well and recovered from the secondary well.

6. The process of claim 1 wherein the treatment fluid is pumped into the secondary well and recovered from the primary well.

7. The process of claim 1 further comprising the steps of:

continuing to drill the secondary well such that the secondary wellbore intersects a third wellbore to create a second intersection, the intersection being situated relatively near to a secondary production zone, and introducing the treatment fluid into the primary or secondary well such that increased production is stimulated from the secondary production zone.

8. A process for increasing production of a well, the well including a primary well having a primary wellbore and a primary production zone, the process comprising the steps of:

drilling a secondary well with a secondary wellbore such that the secondary wellbore intersects the primary wellbore to create an intersection, the intersection being situated relatively near to the primary production zone, wherein the primary well is defined by a length in excess of one kilometer in length and wherein the primary well is a horizontal well, introducing a treatment fluid into the primary or secondary well such that increased production is stimulated from the production zone of the primary well, wherein the treatment fluid is an acid treatment fluid.

9. A process for increasing production of a well, the well including a primary well having a primary wellbore and a primary production zone, the process comprising the steps of:

drilling a secondary well with a secondary wellbore such that the secondary wellbore intersects the primary wellbore to create an intersection, the intersection being situated relatively near to the primary production zone, wherein the primary well is defined by a length in excess of one kilometer in length and wherein the primary well is a horizontal well; and, introducing a treatment fluid into the primary or secondary well such that increased production is stimulated from the production zone of the primary well, wherein the treatment fluid is an acid treatment fluid and the treatment fluid does not pass through a coil tubing unit.

* * * * *